US006438769B1

(12) United States Patent
Luckenbill

(10) Patent No.: US 6,438,769 B1
(45) Date of Patent: Aug. 27, 2002

(54) MOBILE SEAT LIFTING APPARATUS

(76) Inventor: Mike Rex Luckenbill, 6239 Spencer Glen Way, Sugarland, TX (US) 77479

( * ) Notice: Subject to any disclaimer, the term of this patent is extended or adjusted under 35 U.S.C. 154(b) by 0 days.

(21) Appl. No.: 10/038,122

(22) Filed: Jan. 2, 2002

Related U.S. Application Data

(63) Continuation of application No. 09/465,639, filed on Dec. 17, 1999, now abandoned.

(51) Int. Cl.[7] ..... A47K 13/10; A47C 1/00

(52) U.S. Cl. ..... 4/667; 4/483; 297/183.9; 297/330; 297/DIG. 10

(58) Field of Search ..... 4/667, 483, 254; 297/183.9, 326, 330, 313, DIG. 10

(56) References Cited

U.S. PATENT DOCUMENTS 4,168,552 A * 9/1979 Austin ..... 4/667
4,884,841 A * 12/1989 Holley ..... 297/DIG. 10 X
5,561,872 A * 10/1996 Phillips ..... 4/667
5,588,162 A * 12/1996 Robinson ..... 4/667
6,035,462 A * 3/2000 Bennett et al. ..... 4/667

* cited by examiner

*Primary Examiner*—David J. Walczak
*Assistant Examiner*—Kathleen J. Prunner
(74) *Attorney, Agent, or Firm*—Kenneth M. Bush

(57) ABSTRACT

The mobile seat lifting apparatus pivots a seat member between a sitting position and a standing position and includes a frame assembly and a seat assembly pivotally connected thereto, an actuator connected to the seat assembly, and a driving mechanism connected to the actuator to pivot the seat assembly between the standing position and the sitting position. The frame assembly includes a floor brace that is able to securely support the remainder of the frame assembly and the attached seat assembly with a user sitting thereon. The frame assembly further includes a seat brace and a support arm, wherein the support arm connects the seat brace with the floor brace. The actuator is preferably connected between the floor brace and the seat brace such that the actuator additionally supports the seat brace in either the standing position or the sitting position.

9 Claims, 7 Drawing Sheets

MOBILE SEAT LIFTING APPARATUS

CROSS-REFERENCE TO RELATED APPLICATION

This application is a continuation of application Ser. No. 09/465,639 filed on Dec. 17, 1999 and entitled "Mobile Seat Lifting Apparatus", now abandoned.

FIELD OF THE INVENTION

The present invention relates to a seat lifting apparatus, and, more specifically, the present invention relates to a mobile seat lifting apparatus that is able to lower and raise a toilet seat over a conventional toilet and thereafter easily be moved to various other toilets as desired, and that is further able to be converted to be used with a chair member when not positioned proximately to a toilet.

BACKGROUND OF THE INVENTION

Powered lift toilet seats have been disclosed in a number of varying designs for lowering and raising a user with respect to a conventional toilet. Such designs are particularly useful for persons whose movements are hampered or made difficult as a result of age, illness, incapacitation, injury, or handicap. These afflicted persons find it arduous to sit down onto a seat and thereafter ascend to a standing position from that seat without assistance from another person. In attempting to solve these problems, several designs have been provided to pivotally move the toilet seat to aid a user in utilizing a toilet. For example, U.S. Pat. No. 3,473,174 to Cool describes a power tilted seat construction that is attached to a toilet bowl and the surrounding flooring to lower the user into a sitting position with respect to the toilet bowl and raise the user from that sitting position on the toilet bowl. Additionally, U.S. Pat. No. 4,833,736 to Sadler et al. describes a seating assist apparatus that is mounted to a conventional toilet bowl, and this seating assist apparatus is used to assist a person in sitting on a toilet. In both of these designs, the seating apparatus is either mounted or necessarily supported by the toilet for use by the individual.

As a result of the fixed position, the persons using either assembly would not be able to move the seating apparatus from one toilet to another without excessive difficulty. Moreover, the seating apparatus would not be able to be used without the aid provided by the toilet as a means of support or foundation. Such designs raise problems of stability with the seating apparatus itself and they are not easily adaptable to be used with various independently shaped toilets that have varying aesthetic and functional designs.

What is needed, then, and not found in the prior art, is a mobile seat lifting apparatus that is able to be easily moved to various locations to aid the user in sitting and standing, and that is further useful with the varying designs of conventional toilets.

SUMMARY OF THE INVENTION

An object of the present invention is to provide a free-standing mobile seat lifting apparatus that is able to pivot a seat member attached to a frame assembly between a standing position and a sitting position to aid a user to move between said positions.

A further object of the present invention is to provide a mobile seat lifting apparatus that can be easily moved to operate with multiple toilet bowls having varying designs.

A further object of the present invention is to provide a mobile seat lifting apparatus that may interchangeably operate with a toilet seat member or a chair member.

A further object of the present invention is to provide a mobile seat lifting apparatus having an attachable receptacle for the collection and disposal of waste.

These and other objects of the invention are accomplished through the present mobile seat lifting apparatus. The mobile seat lifting apparatus includes a frame assembly and a seat assembly pivotally connected thereto, and a driving means used to pivot the seat assembly from a standing position to a sitting position. The frame assembly includes a floor brace that is able to securely support the remainder of the frame assembly and the attached seat assembly with a user sitting thereon. The frame assembly further includes a seat brace and a support arm, wherein the support arm is connected between the seat brace and the floor brace. Moreover, the driving means is preferably connected between the floor brace and the seat brace such that the driving means additionally supports the seat brace in either the standing position or the sitting position.

The seat assembly is thereby designed to engage a conventional toilet seat member such that the mobile seat lifting apparatus can substantially enclose the space proximately around a conventional toilet bowl such that the user may be lowered and raised with respect to the toilet bowl. Additionally, the frame assembly of the mobile seat lifting apparatus is able to be freestanding from any additional bracing members (such as the toilet itself), and therefore the mobile seat lifting apparatus is able to be transported to various desired locations around varying toilets.

In addition, the frame assembly is designed to also receive a chair member to be mounted thereon. In such an embodiment, the person using the mobile seat lifting apparatus may facilely replace the toilet seat member with the chair member such that the mobile seat lifting apparatus may be used without reference to the toilet as well.

Moreover, the frame assembly is designed to receive an attachable receptacle for the collection and disposal of waste. Such a receptacle may be affixed onto the support arm below the seat brace to work in much the same way as a conventional toilet, wherein the receptacle may easily be detached from the support arm to dispose of any waste.

Further aspects of the present invention will become apparent during the course of the following description and by reference to the attached drawings.

BRIEF DESCRIPTION OF THE DRAWINGS

A mobile seat lifting apparatus embodying the features of the present invention is depicted in the accompanying drawings which form a portion of this disclosure and wherein.

DESCRIPTION OF THE PREFERRED EMBODIMENTS

Figure 1A:
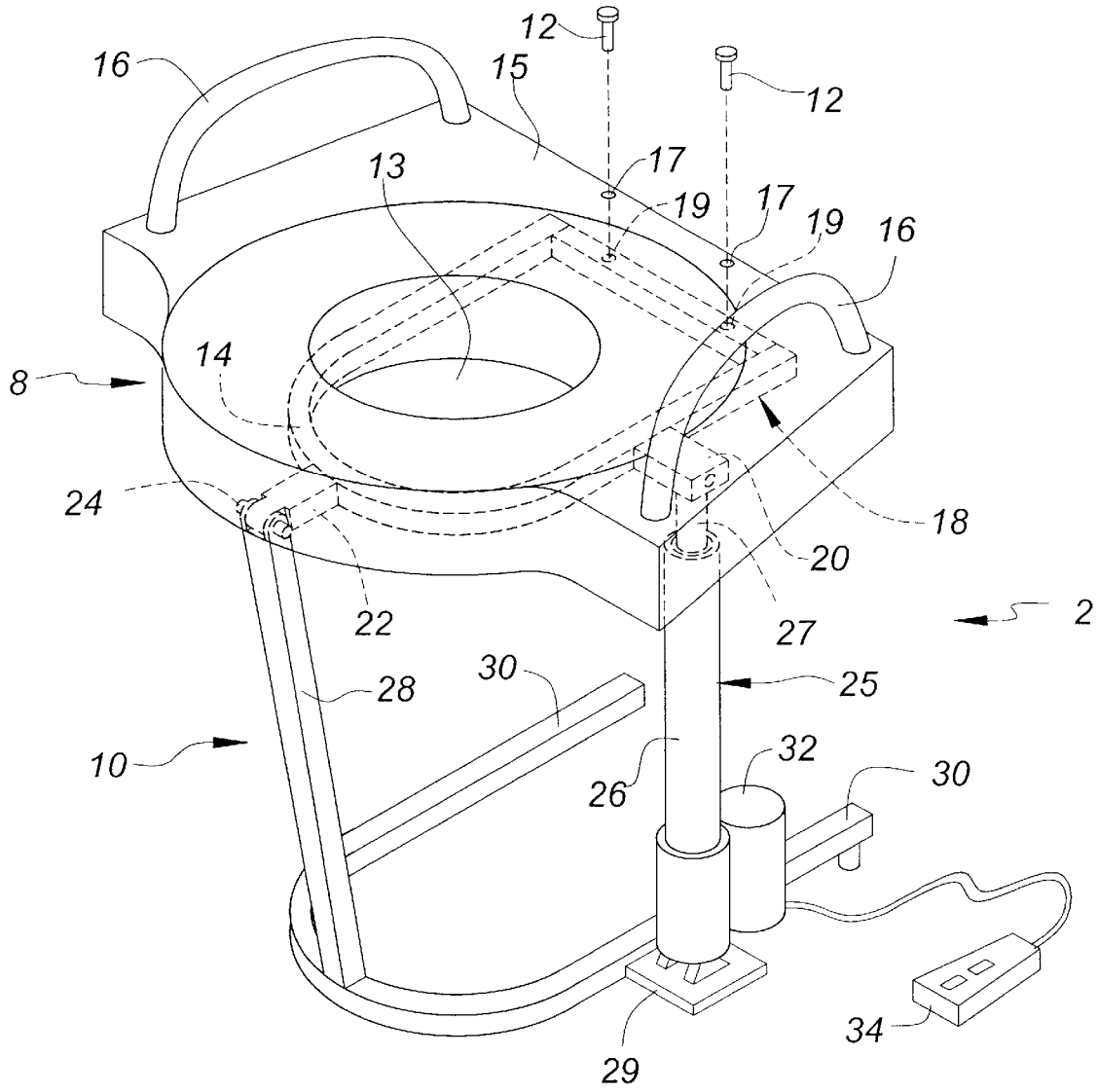
FIG. 1A is a perspective view of the mobile seat lifting apparatus of the present invention, the mobile seat lifting apparatus including a seat assembly and a frame assembly.
Figure 1B:
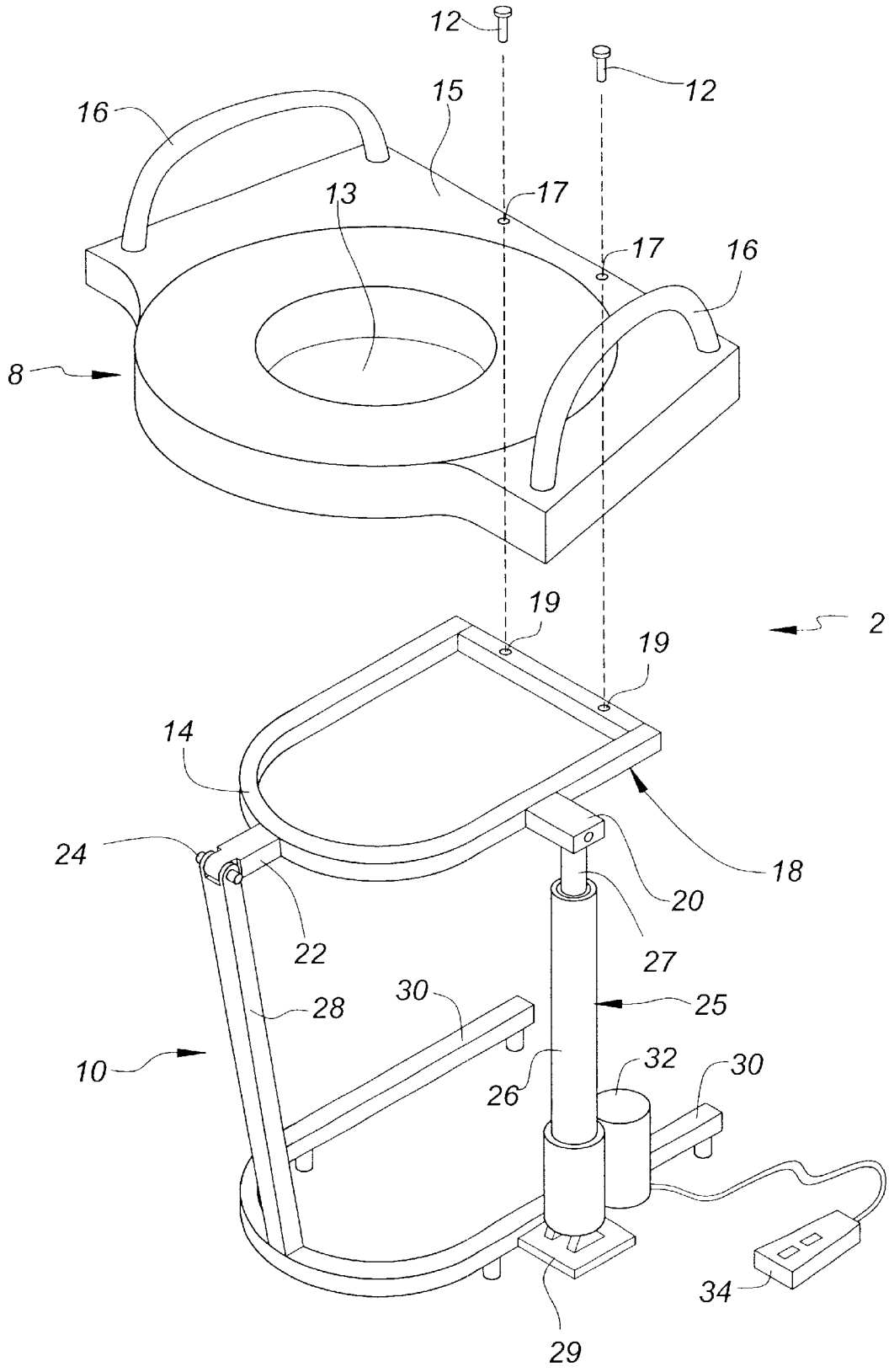
FIG. 1B is a perspective view of the mobile seat lifting apparatus of the present invention as illustrated in FIG. 1A, with the seat assembly exploded above the frame assembly.
Figure 2:
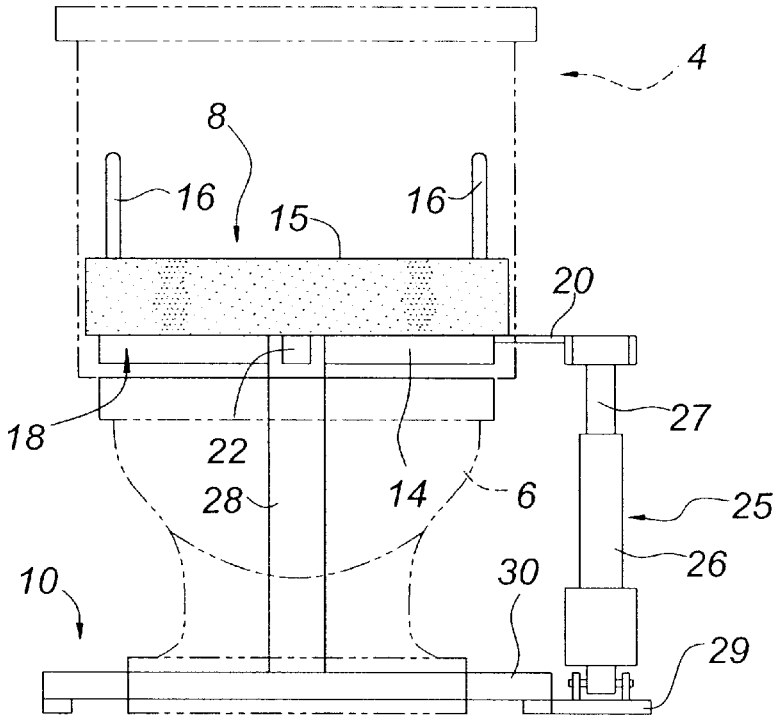
FIG. 2 is a front elevational view of the mobile seat lifting apparatus of the present invention used in conjunction with a toilet, the toilet being illustrated in phantom.
Figure 3:
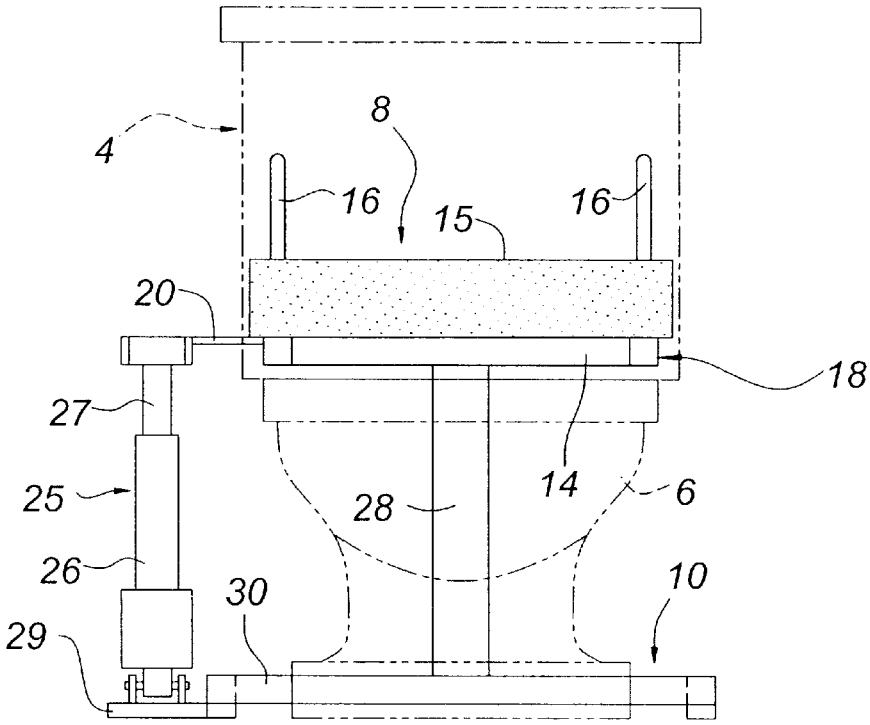
FIG. 3 is a rear elevational view of the mobile seat lifting apparatus of the present invention used in conjunction with a toilet, the toilet being illustrated in phantom.
Figure 4:
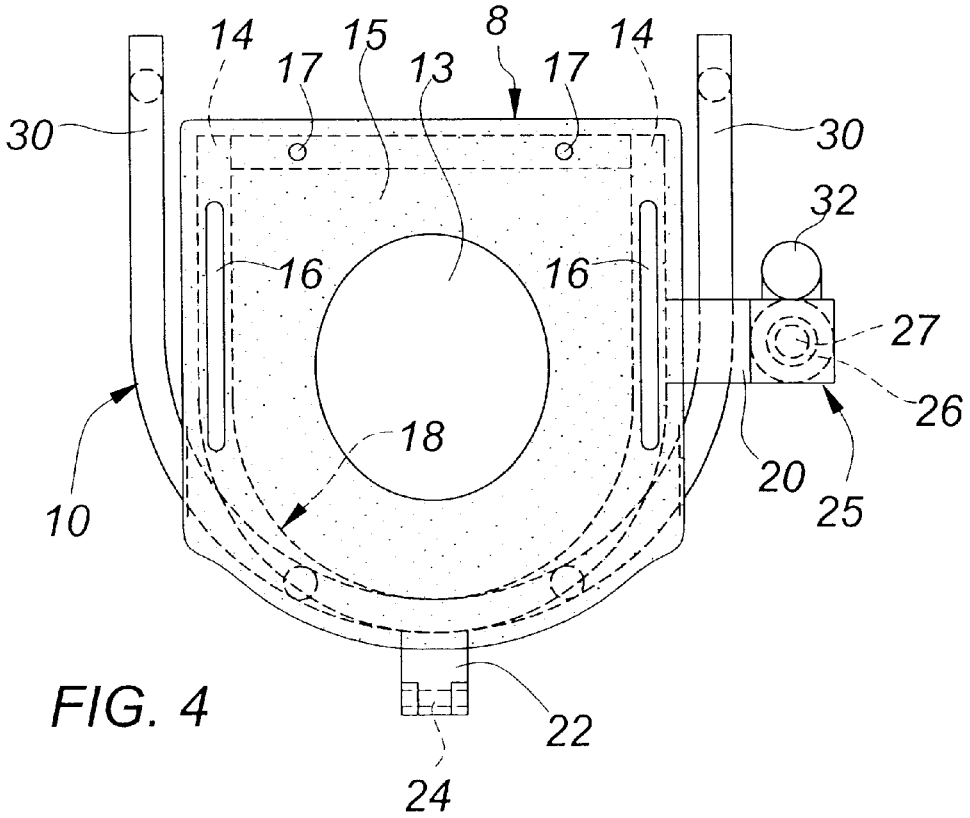
FIG. 4 is a top plan view of the mobile seat lifting apparatus of the present invention, a portion of the frame assembly being illustrated in phantom.
Figure 5:
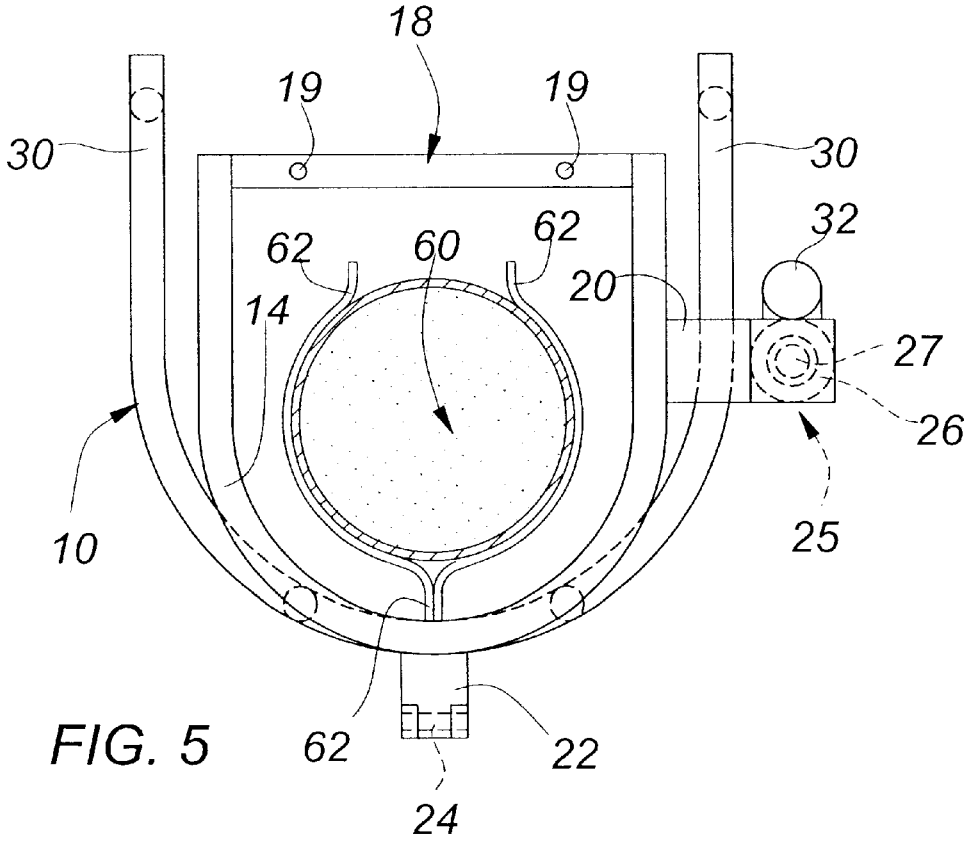
FIG. 5 is a top plan view of the frame assembly of the mobile seat lifting apparatus of the present invention.

Looking at FIGS. 1A and 1B, the mobile seat lifting apparatus 2 of the present invention is illustrated. The mobile seat lifting apparatus 2 includes two main components: a seat assembly 8 and a freestanding frame assembly 10. The seat assembly 8 includes a seat member 15 and a pair of support handles 16 that are mounted thereon. The frame assembly 10 includes a seat brace 18 and a floor brace 30 that is preferably U-shaped. A support arm 28 has one end rigidly connected to the floor brace 30, and extends forwardly and upwardly from the floor brace 30 to pivotally engage a flange 32 of the seat brace 18 at its opposite end. Additionally, an actuator means 25 is connected between the seat brace 18 and the floor brace 30 to provide an arcuate motion for the seat brace 18. The actuator means 25 is further powered by a drive means 32 to provide the arcuate motion of the seat brace 18.

Figure 6C:
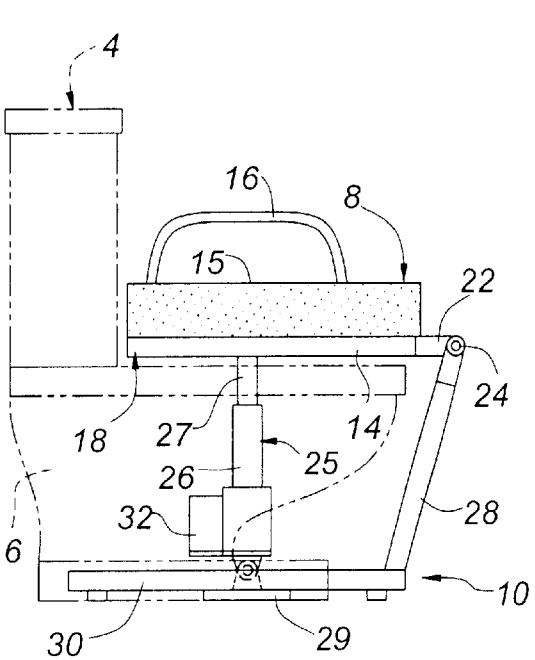
FIG. 6C is a side elevational view of a second side of the mobile seat lifting apparatus of the present invention opposite the first side view illustrated in FIG. 6B, this view showing the mobile seat lifting apparatus in the sitting position, the toilet being illustrated in phantom.
Figure 6B:
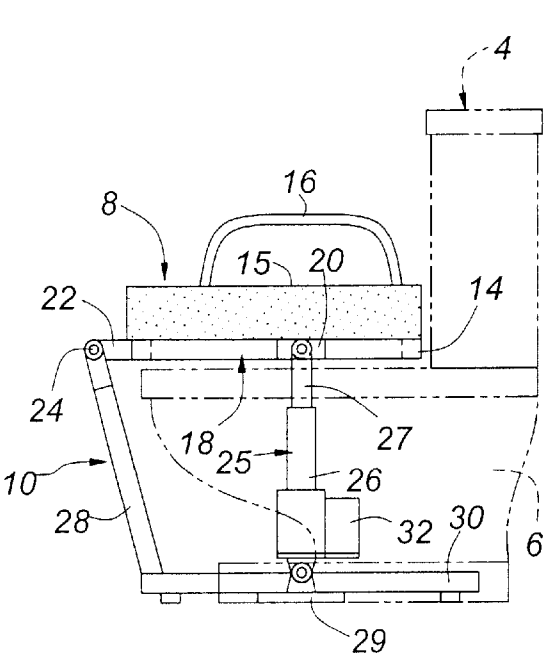
FIG. 6B is a side elevational view of a first side of the mobile seat lifting apparatus of the present invention as illustrated in FIG. 6A, this view showing the mobile seat lifting apparatus in the sitting position, the toilet being illustrated in phantom.
Figure 6A:
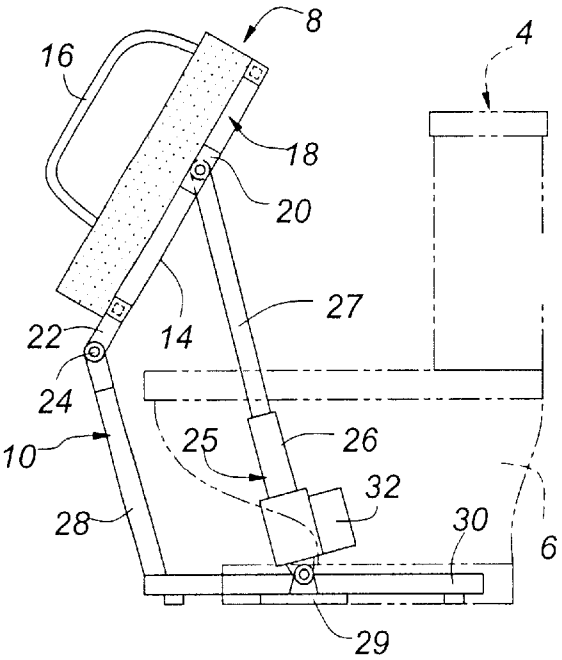
FIG. 6A is a side elevational view of the mobile seat lifting apparatus of the present invention, with the view showing the mobile seat lifting apparatus in the standing position, the toilet being illustrated in phantom.
Figure 8:
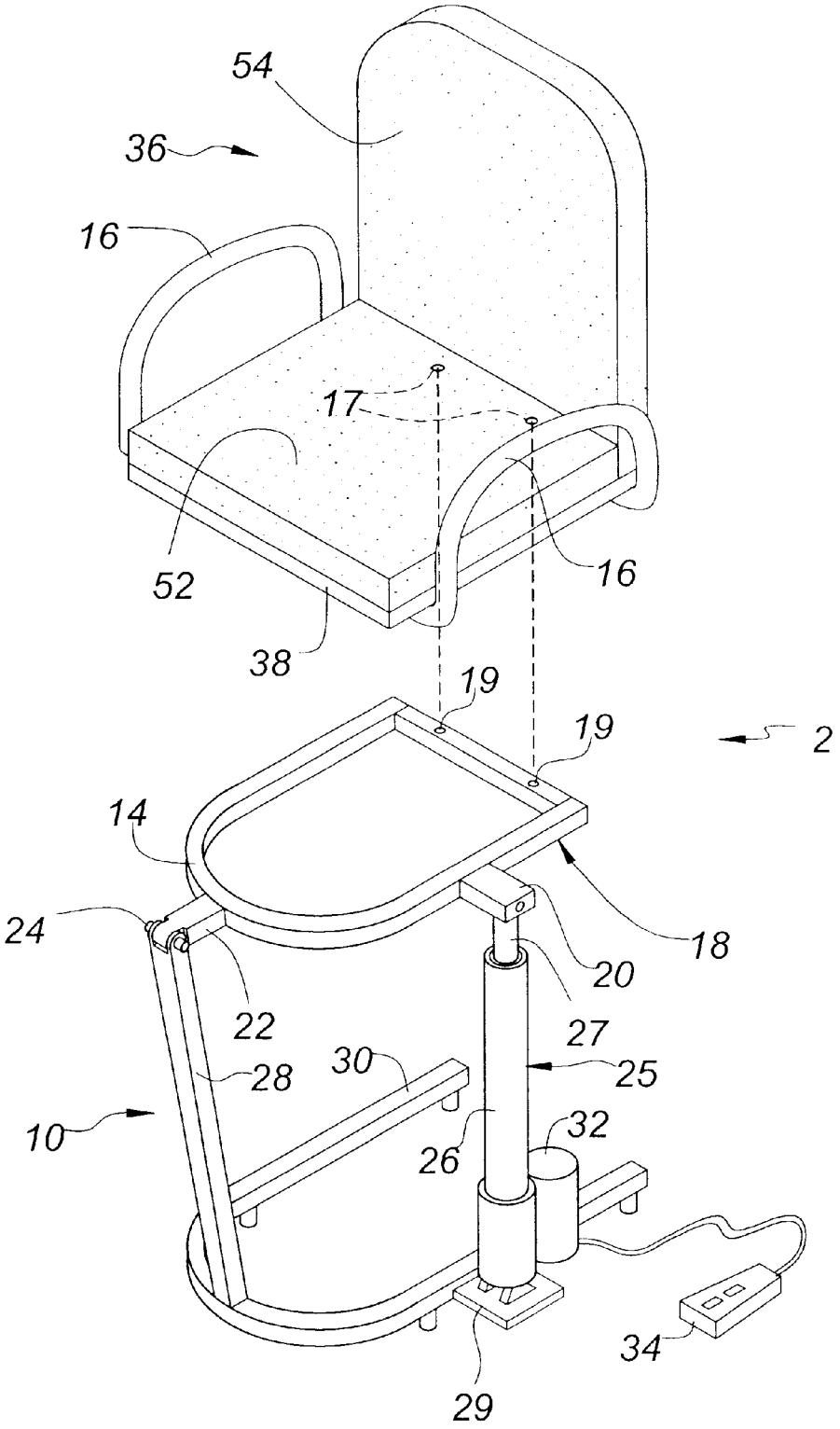
FIG. 8 is a perspective view of the mobile seat lifting apparatus of the present invention including a chair member attached to the frame assembly, the chair member shown exploded from the frame assembly.

More specifically, the seat member 15 is designed to receive a person who is to be lowered from a standing position (as illustrated in FIG. 6A) into a sitting position (as illustrated in FIG. 6B) and raised from the sitting position into the standing position. The seat brace 18 provides support for the person and the seat assembly 8 (as illustrated in FIG. 1B) or a chair member 36 (as illustrated in FIG. 8), among other similar embodiments. The seat member 15 includes a pair of connecting apertures 17 that are positioned to coincide with a pair of mounting apertures 19 traversing the seat brace 18. As a result, the seat member 15 is easily mounted and removably attached onto the seat brace 18 using a pair of connecting members 12 which are able to traverse the connecting apertures 17 and the mounting apertures 19 to lock the seat member 15 with the seat brace 18.

As stated above, the frame assembly 10 is designed such that the seat brace 18 may be pivoted to lower a person from the standing position (shown in FIG. 6A) to the sitting position (shown in FIG. 6B), or to raise the person from the sitting position into the standing position. Looking at FIG. 1B, the seat brace 18 is illustrated as including a central support member 14 with a side flange 20 and a centrally disposed flange 22 extending forwardly therefrom and integrally attached thereto. The forward flange 22 is pivotally connected to the support arm 28 via a pivoting pin 24 such that the pivotal axis between the support arm 28 and the flange 22 is in a forwardmost position relative to the apparatus 2. The side flange 20 is firmly connected to the actuator means 25 to receive a force from the actuator means 25 to pivot the seat brace 18 with respect to the pivoting pin 24, as directed by the operation of the actuator means 25. The frame assembly 10 additionally includes a floor brace 30 that is preferably substantially U-shaped such that the frame assembly 10 may slidingly engage and surround a toilet bowl 6 (see FIGS. 6A–6C) without contacting the toilet bowl 6. Other shapes of the floor brace 30 may be designed as required according to the specific toilet bowl 6, such as a V-shape, so long as the floor brace 30 is operable to support the person using the seat assembly 8 attached to the frame assembly 10. Additionally, a set of rollers (not illustrated) may be attached to the floor brace 30 to aid in moving the seat assembly 8 to various positions, and a conventional breaking mechanism (not illustrated) may be attached to each roller to prevent undesired movement of the seat assembly 8. Each of the elements of the frame assembly 10 are preferably made of an alloy that provides the strength and rigidity necessary for the mobile seat lifting apparatus 2, and such alloys include steel, stainless steel, or aluminum.

Looking further at FIG. 1B, the actuator means 25 is a conventional linear actuating assembly that preferably includes a piston rod 27 and a piston cylinder 26 supported by a pivoting foot 29. The actuator means 25 can further be any other means for applying a linear pressure to raise and lower the seat brace 18, such as a hydraulic cylinder or a linear actuator. The actuator means 25 is thereby connected to a driving means 32 that controls the extending and retracting movement of the piston rod 27 within the piston cylinder 26. The driving means 32 is preferably a conventional motor that is able to control the actuator means 25 to operate in a very slow and steady motion to assist the person in either standing up or sitting down. A controller 34 is additionally attached to the driving means 32 to control the operation of the driving means 32 to determine whether the piston rod 27 is to be extended or retracted within the piston cylinder 26. The controller 34 may be attached to the seat assembly 8 so that the controller 34 is easily accessible by the user. Moreover, the pivoting foot 29 is provided so that when the piston rod 27 is extended to upwardly push the seat brace 18, the piston cylinder 26 is able to pivot on the pivoting foot 29 to aid in the extension of the actuator means 25.

In the preferred embodiment as shown in FIG. 1A, a seat member 15 (preferably a conventional toilet seat) is attached to the seat brace 18 to aid the person using the mobile seat lifting apparatus 2 in sitting over a conventional toilet 4 (illustrated in FIGS. 6A and 6B). The seat member 15 can be one of various conventional toilet seat shapes, such as a raised toilet seat (illustrated in FIGS. 1A and 1B) or a conventional flat toilet seat. In any of these embodiments, the seat member 15 will include the pair of connecting apertures 17 positioned toward the rear of the seat member 15 such that the seat member 15 may be securely attached to the seat brace 18 of the frame assembly 10. Furthermore, the seat member 15 includes a conventional central cavity 13 that is designed to be positioned over the toilet bowl 6 during use.

Figure 7:
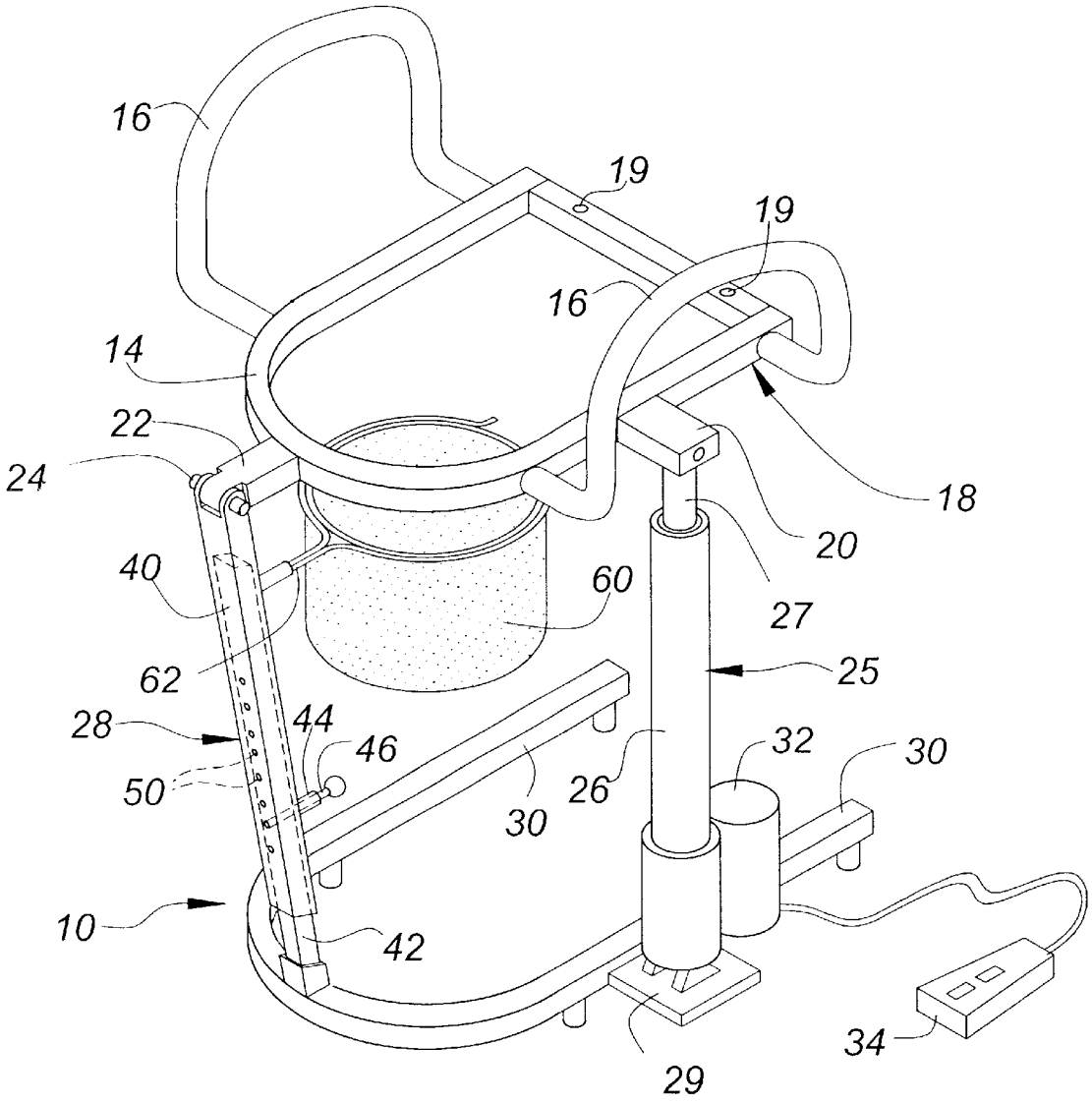
FIG. 7 is a perspective view of a second embodiment of a frame assembly used in the mobile seat lifting apparatus of the present invention, this embodiment including a means for adjusting the distance between the seat assembly and the frame, and also including a pair of arms attached to the frame assembly and a receptacle attached to the support arm.

In another embodiment of the invention as illustrated in FIG. 7, the length of the support arm 28 may be extended or retracted to modify the distance between the seat brace 18 and the floor brace 30. In such an embodiment, the support arm 28 includes an upper bar 40 telescopic with a lower bar 42. The upper bar 40 is pivotally connected to the seat brace 18, and the lower bar 42 is rigidly connected to the floor brace 30. Both the upper bar 40 and the lower bar 42 are substantially hollow, with the cross-sectional area of the lower bar 42 being less than that of the upper bar 40 such that the upper bar 40 can slide over the lower bar 42. A pin retaining cylinder 44 is mounted on the outside surface of the upper bar 40 to provide support for a positioning pin 46. Both the lower bar 42 and the upper bar 40 include a series of positioning apertures 50 which may receive the positioning pin 46 so that the distance between the seat brace 18 and the floor brace 30 can be adjusted. Accordingly, the upper bar 40 will therein slide over the lower bar 42 such that the positioning pin 46 3 will engage one of the positioning apertures 50. As a result, the distance between the floor brace 30 and the seat brace 18 will be determined according to which positioning aperture 50 the positioning pin 46 engages.

Looking at FIG. 8, a second embodiment of the invention is illustrated herein a chair member 36 is mounted on the seat brace 18. In such an embodiment, the floor brace 30 remains operable to securely support the person sing the chair member 36. The chair member 36 includes a bottom member 52 and back member 54. A base plate 38 is attached to the bottom member 52, and the base plate 38 includes a pair of connecting apertures 17 which coincide with the mounting apertures 19 of the seat brace 18 to easily mount the chair member 36 to the seat brace 18. As a result, either the chair member 36 or the seat member 15 may be easily mounted to the seat brace 18 such that the two are easily interchangeable, and since the frame assembly 10 is free-standing and easily transportable, the mobile seat lifting apparatus 2 may be moved as desired. Consequently, the person is able to determine the desired use of the mobile seat lifting apparatus 2 and incorporate the desired seat member 15 or chair member 36 accordingly.

Referring back to FIGS. 1A, 1B, 7, and 8, the mobile seat lifting apparatus 2 is shown further including various pairs of arm handles 16 for use by the person using the mobile seat lifting apparatus 2. In one embodiment illustrated in FIGS. 1A and 1B, the arm handles 16 are affixed to the seat member 15 itself. Looking at FIG. 7, the arm handles 16 may also be attached to the seat brace 18 such that they are available for use with either the seat member 15, the chair member 36, or any other embodiment that is attached to the seat brace 18. Moreover, looking at FIG. 8, when the mobile seat lifting apparatus 2 includes a chair member 36, the arm handles 16 may be connected to the base plate 38 attached to the bottom member 52 to provide the support desired by the person using the mobile seat lifting apparatus 2.

Looking further at FIG. 7, the frame assembly 10 is designed to also support a waste receptacle 60, such as a bucket, or similar means for collecting waste to be used in lieu of a toilet bowl 6. In such an embodiment, the receptacle 60 may be removeably attached to the upper bar 40 via a receptacle clamp 62 such that the receptacle 60 is positioned below the seat brace 18. The receptacle clamp 62 may either be attached to the upper bar 40 or it may be clamped to the upper bar 40 using a bracket (not illustrated). Accordingly, the receptacle 60 may take the place of the conventional toilet bowl 6, which allows the mobile seat lifting apparatus 2 to be used in locations where a toilet is not available. Such an embodiment is therefore effective in helping the user who cannot easily move or easily be moved to the toilet.

Thus, although there have been described particular embodiments of the present invention of a new and useful MOBILE SEAT LIFTING APPARATUS, it is not intended that such references be construed as limitations upon the scope of this invention except as set forth in the following claims.

What is claimed is:

1. An apparatus for moving a person between a standing position and a seated position in relation to a waste receptacle, comprising:

a. a substantially U-shaped floor brace;

b. a seat brace having a centrally disposed flange extending forwardly therefrom;

c. means for supporting said seat brace above said floor brace, wherein said supporting means comprises a centrally disposed support arm rigidly connected at one end to said floor brace and pivotally connected at an opposite end to said flange, wherein said support arm extends forwardly and upwardly from said floor brace to engage said flange such that the pivotal axis between said support arm and said flange is in a forwardmost position relative to said apparatus; and d. means attached to said seat brace for moving said seat brace between a substantially vertical position and a substantially horizontal position.

2. An apparatus according to claim 1, further comprising a seat member removably attached to said seat brace.

3. An apparatus according to claim 1, wherein said support arm is telescopic to adjust the distance between said seat brace and said floor brace.

4. An apparatus according to claim 1, further comprising a waste receptacle removably attached to said support arm.

5. An apparatus for moving a person between a standing position and a seated position in relation to a waste receptacle, comprising:

a. a seat brace having a centrally disposed flange extending forwardly therefrom;

b. a floor brace having a centrally disposed support arm extending forwardly and upwardly therefrom, wherein said support arm is rigidly connected at one end to said floor brace and pivotally connected at an opposite end to said flange such that the pivotal axis between said support arm and said flange is in a forwardmost position relative to said apparatus; and c. means attached to said seat brace for moving said seat brace between a substantially vertical position and a substantially horizontal position.

6. An apparatus according to claim 5, further comprising a seat member removably attached to said seat brace.

7. An apparatus according to claim 5, wherein said support arm is telescopic to adjust the distance between said seat brace and said floor brace.

8. An apparatus according to claim 5, further comprising a waste receptacle removably attached to said support arm, said waste receptacle being positioned below said seat brace.

9. An apparatus according to claim 5, wherein said floor brace is substantially U-shaped.

* * * * *